US005436697A

United States Patent [19]

Negishi

[11] Patent Number: 5,436,697

[45] Date of Patent: Jul. 25, 1995

[54] IMAGE POTENTIAL CONTROL SYSTEM AND IMAGE FORMING APPARATUS USING THE SAME

[75] Inventor: Hiroyuki Negishi, Tokyo, Japan

[73] Assignee: Ricoh Company, Ltd., Tokyo, Japan

[21] Appl. No.: 155,773

[22] Filed: Nov. 23, 1993

[30] Foreign Application Priority Data

Nov. 30, 1992 [JP] Japan ..... 4-321015

[51] Int. Cl.[6] ..... G03G 21/00

[52] U.S. Cl. ..... 355/208; 355/203; 355/204; 395/900

[58] Field of Search ..... 355/204, 208, 200, 203, 355/246, 214; 395/900, 128

[56] References Cited

U.S. PATENT DOCUMENTS

| | | | |
|---|---|---|---|
| 5,029,314 | 7/1991 | Katsumi et al. | 355/208 |
| 5,204,718 | 4/1993 | Morita | 355/208 X |
| 5,216,463 | 6/1993 | Morita | 355/208 |
| 5,220,373 | 6/1993 | Kanaya | 355/204 |
| 5,231,452 | 7/1993 | Murayama et al. | 355/208 |
| 5,262,833 | 11/1993 | Fukushima et al. | 395/900 X |
| 5,307,118 | 4/1994 | Morita | 355/208 |
| 5,317,368 | 5/1994 | Shimomura et al. | 355/208 X |

FOREIGN PATENT DOCUMENTS 167655 7/1991 Japan .

*Primary Examiner*—Matthew S. Smith

*Attorney, Agent, or Firm*—Popham, Haik, Schnobrich & Kaufman, Ltd.

[57] ABSTRACT

An image potential control system is adapted to control an image potential of a photosensitive body of an image forming apparatus which includes controlled systems including the photosensitive body and carries out an electrophotography process. The image potential control system includes a storage for storing at least controlled variables of the controlled systems and a control program, and a processing unit for controlling the controlled variables based on the control program and for adjusting a dark portion potential and a bright portion potential of the photosensitive body using a neural operation. The processing unit includes an adjusting part for comparing a learned characteristic of a reference image forming apparatus and a characteristic of the image forming apparatus and adding differences between the characteristics to input data or output data of the neural operation as adjusting values.

14 Claims, 7 Drawing Sheets

IMAGE POTENTIAL CONTROL SYSTEM AND IMAGE FORMING APPARATUS USING THE SAME

BACKGROUND OF THE INVENTION

The present invention generally relates to image potential control systems and image forming apparatuses, and more particularly to an image potential control system which employs neural control to control an image potential (dark portion potential and bright portion potential) on a photosensitive body of an image forming apparatus such as an optical (or laser) printer, a copying machine and a facsimile machine which use the electrophotography technique, and to an image forming apparatus having such an image potential control system.

Conventionally, in image forming apparatuses which use the electrophotography technique, the precision of parts forming the apparatus, the characteristic values at the time of the assembling and the like are managed with respect to process conditions, so as to stably realize images having a high quality. In addition, the process conditions are optimized by detecting controlled variables with respect to the property (quantity of state) and the manipulated variable of each process controller and carrying out a feedback control based on the detected controlled variables.

On the other hand, a neuro-control using a neural network is known. A Japanese Laid-Open Patent Application no.3-167655 shows an example of such a neuro-control. The neural network first searches for a fine solution by giving a degree of freedom in a state where the restricting conditions are not strict. Then, the neural network gradually makes the restricting conditions more strict so as to obtain a solution which is fine to a certain extent and satisfies the restricting conditions.

Accordingly, proposals have been made to employ the neuro-control of the neural network for controlling the process conditions of the image forming apparatus.

However, in order to stabilize the image quality of the image forming apparatus, there are simply too many factors which affect the image quality when the entire process of the image forming apparatus is taken into account. As a result, it is impossible to carry out an established control, and the processes of the image forming apparatus must constantly be adjusted by an expert.

In addition, when the neuro-control is employed, the variation between the characteristic of a particular model of the image forming apparatus at the time when the learning data for the neuro-control are measured and the characteristic of each individual product of this particular model becomes a big problem. In other words, when carrying out the neuro-control, the use of the limited learning data for all of the products introduces differences in the performances of the individual products. For example, it is extremely difficult to constantly control the image potential on the photosensitive body to the optimum state in each of the individual products.

SUMMARY OF THE INVENTION

Accordingly, it is a general object of the present invention to provide a novel and useful image potential control system and image forming apparatus, in which the problems described above are eliminated.

Another and more specific object of the present invention is to provide an image potential control system adapted to control an image potential of a photosensitive body of an image forming apparatus which includes controlled systems including the photosensitive body and carries out an electrophotography process, comprising storage means for storing at least controlled variables of the controlled systems and a control program, and processing means, coupled to the storage means and including adjusting means, for controlling the controlled variables based on the control program and for adjusting a dark portion potential and a bright portion potential of the photosensitive body using a neural operation, where the adjusting means comprises means for comparing a learned characteristic of a reference image forming apparatus and a characteristic of the image forming apparatus and adding differences between the characteristics to input data or output data, of the neural operation as adjusting values. According to the image potential control system of the present invention, it is possible to adjust the differences between the learned characteristic related to the reference image forming apparatus and the characteristic related to each individual image forming apparatus which may vary depending on the production error and the like, and thereby absorb differences in the control among the individual image forming apparatuses. As a result, it is possible to obtain an image having a high quality.

Still another object of the present invention is to provide an image forming apparatus which carries out an electrophotography process, comprising a plurality of controlled systems including a photosensitive body, storage means for storing at least controlled variables of the controlled systems and a control program, and processing means, coupled to the storage means and including adjusting means, for controlling the controlled variables based on the control program and for adjusting a dark portion potential and a bright portion potential of the photosensitive body using a neural operation, where the adjusting means comprises comparing means for comparing a learned characteristic of a reference image forming apparatus and a characteristic of the image forming apparatus and adding differences between the characteristics to input data or output data of the neural operation as adjusting values. According to the image forming apparatus of the present invention, it is possible to adjust the differences between the learned characteristic related to the reference image forming apparatus and the characteristic related to each individual image forming apparatus which may vary depending on the production error and the like, and thereby absorb differences in the control among the individual image forming apparatuses. As a result, it is possible to obtain an image having a high quality.

Other objects and further features of the present invention will be apparent from the following detailed description when read in conjunction with the accompanying drawings.

DESCRIPTION OF THE PREFERRED EMBODIMENTS

Figure 1:
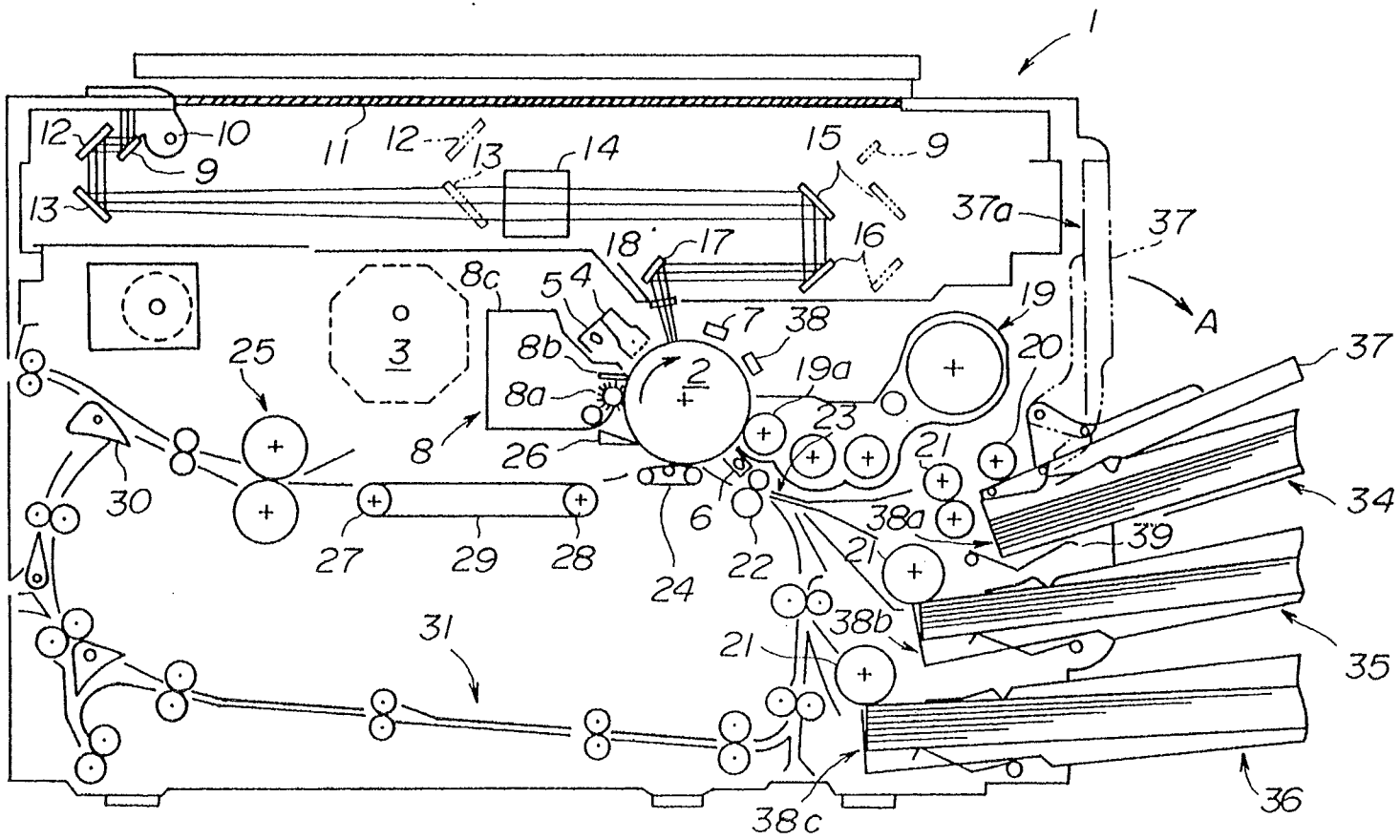
FIG. 1 is a cross sectional view generally showing an essential part of an embodiment of an image forming apparatus according to the present invention.

FIG. 1 generally shows an essential part of an embodiment of an image forming apparatus according to the present invention. In this embodiment, the present invention is applied to a copying machine which uses the electrophotography technique.

First, a description will be given of the construction of a copying machine 1 shown in FIG. 1 in conjunction with a copying operation thereof.

The copying operation of the copying machine 1 starts when a copy start key of an operation panel (not shown) is pushed after setting necessary copying conditions from the operation panel.

A photosensitive drum 2 is rotatably supported on a drum shaft (not shown) and is rotated in a direction of an arrow by a main motor 3 which starts to drive in response to a copy instruction which is issued by the pushing of the copy start key.

At the same time, in order to prevent the residual toner adhered on the photosensitive drum 2 and the non-uniform potential on the photosensitive drum 2 from reaching a charger 4 and a developing unit 19, a discharge lamp 5, a pre-transfer discharge lamp 6, a transfer belt 24, an eraser 7 and a cleaning unit 8 are driven so that the surface potential of the photosensitive drum 2 becomes approximately zero after passing the discharge lamp 5.

Thereafter, when the rotation quantity of the photosensitive drum 2 reaches a predetermined value, a first carriage which integrally comprises a first mirror 9, an exposing lamp 10 and the like optically scans a bottom surface (image surface) of a document which is placed on a contact glass 11. In this state, a second mirror 12 and a third mirror 13 move at a speed which is ½ that of the first carriage. Consequently, a reflected optical image from the document surface is imaged on the photosensitive drum 2 via the first mirror 9, the second mirror 12, the third mirror 13, a through lens 14, a fourth mirror 15, a fifth mirror 16, a sixth mirror 17 and a dustproof glass 18.

On the other hand, the surface of the photosensitive drum 2 is uniformly charged beforehand by the charger 4, and an electrostatic latent image is thereafter formed on the surface of the photosensitive drum 2 when the reflected optical image is imaged on the photosensitive drum 2. In this state, the photosensitive drum 2 and the first carriage are driven at the same speed so that magnification of the copy print is one.

Next, the latent image formed on the photosensitive drum 2 is visualized into a toner image by the developing unit 19 which adheres the toner on the surface of the photosensitive drum 2. In this state, the tone or density of the image can be adjusted by varying the developing bias potential which is applied to a developing roller 19*a*. In addition, it is possible to detect the surface potential (charge potential) of the photosensitive drum 2 using a potential sensor 38 if necessary.

On the other hand, a feed roller 20 and one of three paper supply rollers 21 are driven by turning ON a paper supply clutch (not shown) which can selectively transmit the driving force of the main motor 3. Hence, a transfer sheet (paper) which is set in a selected one of paper supply cassettes 34 through 36 is supplied towards a resist roller pair 22 which is stationary. A resist sensor 23 is arranged in front of the resist roller pair 22 along a paper transport direction. For example, the resist sensor 23 is made up of a reflection type photosensor, and detects the paper when the tip end of the paper reaches a position confronting the resist sensor 23. The paper being transported is stopped by turning OFF the paper supply clutch after a predetermined time. As a result, the tip end of the supplied paper hits the resist roller pair 22 and the paper is positioned at a waiting position ready for the copying operation in a state where a skew of the paper is corrected.

Then, a resist clutch (not shown) is turned ON with a timing matched to the tip end of the image formed on the photosensitive drum 2, and the resist roller pair 22 is rotationally driven to resume transport of the paper which is in the waiting position towards a transfer unit. When the paper reaches the transfer unit, the toner image on the photosensitive drum 2 is transferred onto this paper by the action of the transfer belt 24 of the transfer unit. Thereafter, the paper is separated from the surface of the photosensitive drum 2 by a separation claw 26.

Next, the paper is transported to a fixing unit by a transport belt 29 which is provided across a pair of rollers 27 and 28. A fixing roller 25 of the fixing unit thermally fixes the toner image on the paper. If a one-sided copy mode is selected as the copy mode, the paper is ejected onto an external eject tray (not shown) via an upper side of a switch claw 30. On the other hand, if a two-sided copy mode is selected as the copy mode, the paper is transported to a paper resupplying path 31 on the lower side by the switching of the switch claw 30, so as to advance to the process of transferring a document image on the other side (back side) of the paper.

After the image is transferred from the photosensitive drum 2 onto the paper, the residual toner on the surface of the photosensitive drum 2 is removed by a cleaning brush 8*a* and a cleaning blade 8*b* of the cleaning unit 8 and is recovered into a toner recovery tank 8*c*. In addition, the entire photosensitive surface of the photosensitive drum 2 is exposed by the discharge lamp 5 so as to eliminate the residual charge.

The paper supply cassettes 34 through 36 are detachable with respect to the copying machine 1 and are adapted to accommodate papers of different sizes. A manual feed tray 37 is provided to manually feed a paper having an unspecified size not accommodated in the paper supply cassettes 34 through 36. This manual feed tray 37 is in a closed position indicated by a two-dot chain line in FIG.1 when not in use, and is pivotted in a direction A to an open position indicated by a solid line when in use.

Figure 2:
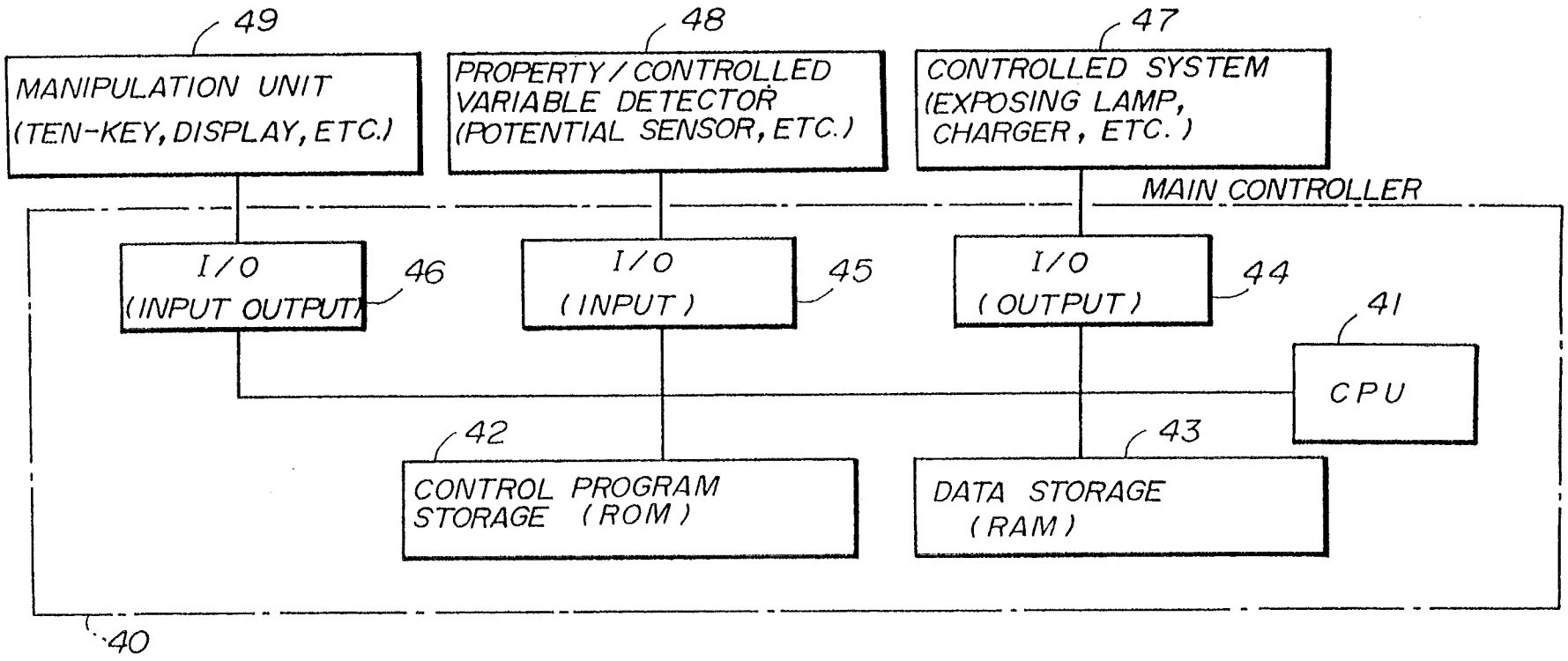
FIG. 2 is a system block diagram generally showing a control system of the copying machine shown in FIG. 1.

Next, a description will be given of a control system of the copying machine 1, by referring to FIG. 2. FIG. 2 generally shows the control system of the copying machine 1.

The control system shown in FIG. 2 includes a main controller 40 which has the functions of a microcomputer. The main controller 40 includes a central processing unit (CPU) 41, a control program storage 42 which is made up of a read only memory (ROM), a data storage 43 which is made up of a random access memory (RAM) or a non-volatile memory), and input/output (I/O) ports 44 through 46. The I/O port 44 is used for output, the I/O port 45 is used for input, and the I/O port 46 is used for both input and output.

The main controller 40 controls a controlled system 47 via the I/O port 44. The controlled system 47 is the exposing lamp 10, the charger 4 or the like. In addition, the main controller 40 inputs signals from a property (quantity of state)/controlled variable detector 48 via the I/O port 45. The property/controlled variable detector 48 includes a sensor such as the potential sensor 38. Further, the main controller 40 exchanges data between a manipulation unit 49 via the I/O port 48. The manipulation unit 49 includes a ten-key, a display or the like.

Figure 3:
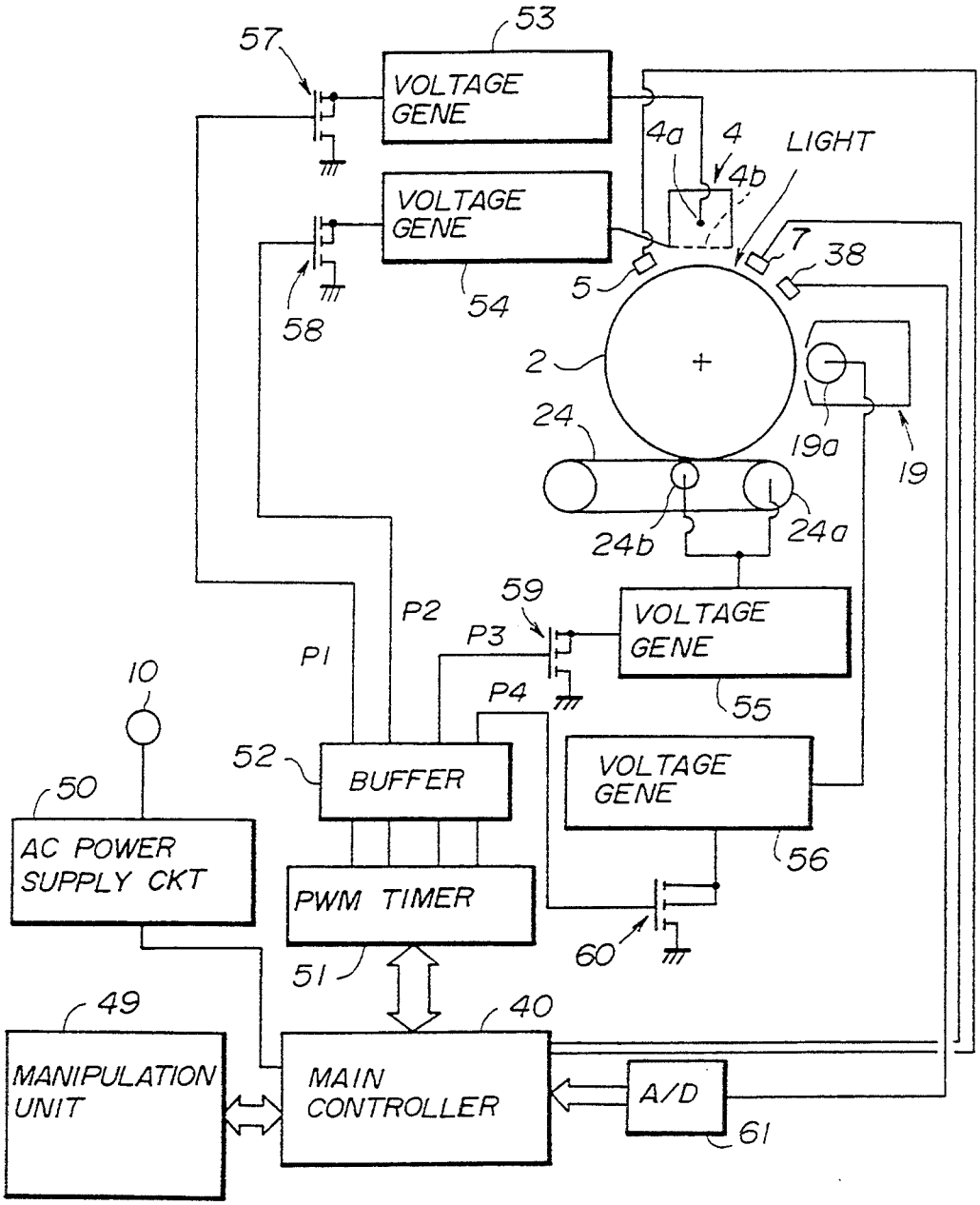
FIG. 3 is a system block diagram showing an essential part of the control system shown in FIG. 2 in more detail.

FIG. 3 shows in more detail an essential part of the control system of the copying machine 1 for controlling light emission from the exposing lamp 10 which is used as the exposing light source and controlling high voltages which are applied to the charger 4, the developing roller 19*a*, the transfer belt 24 and the like. In FIG. 3, those parts which are the same as those corresponding parts in FIGS. 1 and 2 are designated by the same reference numerals, and a description thereof will be omitted.

In the control system shown in FIG. 3, the main controller exchanges data between the manipulation unit 49, and outputs a trigger signal to control an AC power unit circuit 50. The AC power output, that is, the output voltage to the exposing lamp 10, is determined by the length (time) of the trigger signal.

In addition, the main controller 40 controls a pulse width modulation (PWM) timer 51, so that four PWM signals P1 through P4 are output via a buffer 52.

The PWM signal P1 is applied to a gate of a field effect transistor (FET) 57 which is connected to a primary side of a transformer of a high voltage generation circuit 53 which is used for charge voltage generation. The high voltage generated from the high voltage generation circuit 53, that is, the high voltage (charge voltage) applied to a discharge wire 4*a* of the charger 4, is determined by the duty ratio or cycle of the PWM signal P1.

At the same time, the PWM signal P2 is applied to a gate of a FET 58 which is connected to a primary side of a transformer of a high voltage generation circuit 54 which is used for grid voltage generation. The high voltage generated from the high voltage generation circuit 54, that is, the high voltage (grid voltage) applied to a grid of the charger 4, is determined by the duty ratio or cycle of the PWM signal P2.

In addition, the PWM signal P3 is applied to a gate of a FET 59 which is connected to a primary side of a transformer of a high voltage generation circuit 55 which is used for transfer voltage generation. The high voltage generated from the high voltage generation circuit 55, that is, the high voltage (transfer voltage) applied to the transfer belt 24 via conductive rollers 24*a* and 24*b*, is determined by the duty ratio or cycle of the PWM signal P3.

Furthermore, the PWM signal P4 is applied to a gate of a FET 60 which is connected to a primary side of a transformer of a high voltage generation circuit 56 which is used for developing bias voltage generation. The high voltage generated from the high voltage generation circuit 56, that is, the high voltage (developing bias voltage) applied to the developing roller 19*a* within the developing unit 19, is determined by the duty ratio or cycle of the PWM signal P4.

On the other hand, an output detection signal of the potential sensor 38 which detects (measures) the charge potential on the surface of the photosensitive drum 2 is converted into a digital value by an analog-to-digital (A/D) converter circuit 61. This digital value is input to the main controller 40. The main controller 40 also controls the ON/OFF states of the discharge map 5 and the eraser 7.

Figure 4:
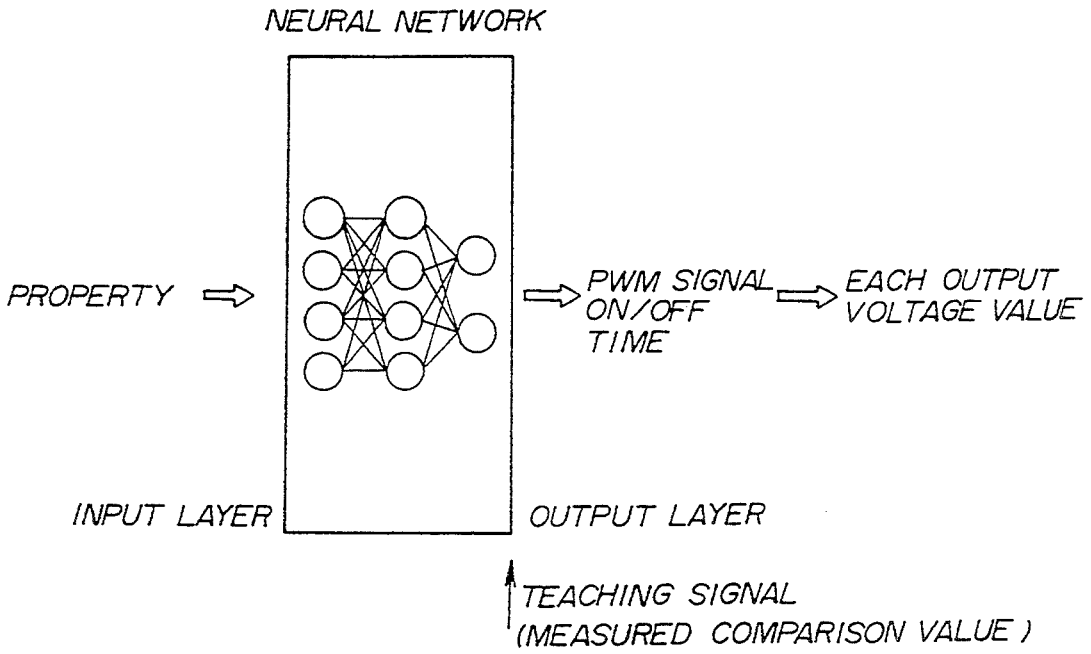
FIG. 4 is a diagram for explaining the relationship of the input and output of a neural network which carries out a learning control.

FIG. 4 is a diagram for explaining the relationship of the input and output of a neural network which carries out a kind of learning control. For the sake of convenience, it is assumed that one output neuron exists with respect to one controlled system, and a neuro operation is carried out for input and output values of 0 to 1. The property (quantity of state), which is the input, is converted into data from 0 to 1 depending on the magnitude thereof. The controlled variable from 0 to 1, which is the output, is converted into a signal value depending on the magnitude thereof. The signal value corresponds to the PWM signal, the trigger signal, or the ON/OFF time.

In this case, the input includes a control target value VG_N for the grid voltage of the charger 4 (hereinafter simply referred to as a grid control target value VG_N), a control target value VLP_N of the voltage (hereinafter referred to as a lamp voltage) applied to the exposing lamp 10 (hereinafter simply referred to as a lamp control target value VLP_N), the peripheral or surrounding temperature of the photosensitive drum 2, and the total number of prints (copies) made. On the other hand, the output includes a dark portion potential VD and a bright portion potential VL.

According to the neuro-control employed in this embodiment, correct input values with respect to certain output values (teaching signals) are taught to the neural network by carrying out an error back-propagation which sends signals from the output layer to the input layer. Not all of the input values need to be obtained with respect to the certain output values, and some of the input values may be unknown. As a result of the learning process, the degree of coupling, that is, the weighting, between the neurons of the neural network is stored so that correct output values will be output even if the input values change.

The PWM signals (P1 through P4) are the signals applied to the bases of the oscillation transistors (FETs 57 through 60 shown in FIG. 3) at the primary sides of the transformers of the high voltage generation circuits (53 through 56), and the outputs of the secondary sides of the transformers are determined by the duty ratios or cycles of the PWM signals. The trigger signal is the signal which controls the output of the AC power supply circuit 50. The output value of the AC power supply circuit 50 is varied depending on the duration (time) of the trigger signal, thereby determining the voltage value applied to the exposing lamp 10. In addition, the ON/OFF time is the ON/OFF time of the input power supply with respect to a certain controlled system, and the output value of the controlled system is determined by the length of the ON/OFF time.

The dark portion potential (dark pattern potential) VD refers to the latent image potential which appears on the photosensitive drum 2 when the exposing lamp 10 Of a scanner unit irradiates light on a specific dark pattern (not shown) while the charge voltage is applied from the high voltage generation circuit 53 to the discharge wire 4*a* and the grid voltage is applied from the high voltage generation circuit 54 to the grid 4*b*.

On the other hand, the bright portion potential (bright pattern potential) VL refers to the latent image potential which appears on the photosensitive drum 2 when the exposing lamp 10 of a scanner unit irradiates light on a specific bright pattern (not shown) while the charge voltage is applied from the high voltage generation circuit 53 to the discharge wire 4*a* and the grid voltage is applied from the high voltage generation circuit 54 to the grid 4*b*.

Figure 5:
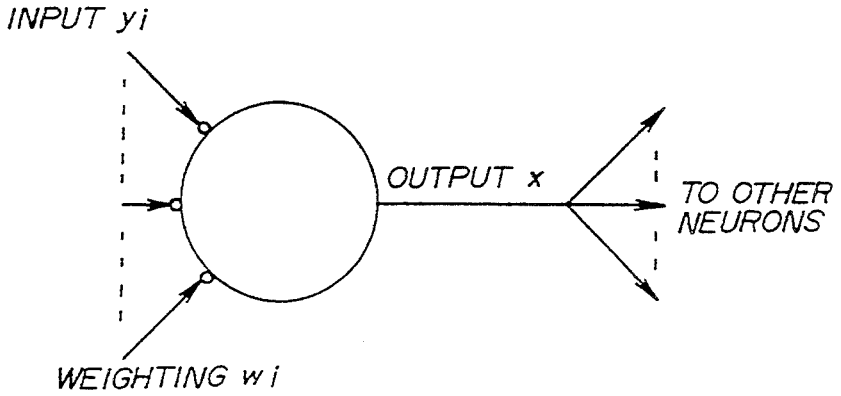
FIG. 5 is a diagram for explaining a neuron model of the learning control.

FIG. 5 is a diagram for explaining a neuron model of the neuro-control, that is, the learning control. In FIG. 5, yi denotes an ith input value, wi denotes a synapse coupling coefficient (weighting coefficient) of the ith input, and X denotes the output value of the neuron.

The functions of the neuron may be described in a simple manner by a multiple-input, one-output, non-linear. element. The design of the neuron varies depending on how the neuron model is to realize the non-linear characteristic of the actual neuron.

In this embodiment, a discrete time model is used, as described by the following formula (1), where X(t+1) denotes an output of the neuron at a time t+1, f denotes an output function, wi denotes a synapse coupling coefficient (weighting coefficient) of an ith input, yi(t) denotes the ith input value at a time t, $\theta$ denotes a threshold value, and N denotes a number of hierarchical layers.

$$X(t+1) = f\left(\sum_{i=1}^{n} wiyi(t) - \theta\right) \quad (1)$$

The output function f can be described by the following formula (2), where $\epsilon$ denotes a non-negative parameter which determines the non-linearity of the output function f.

$$f(u) = 1/[1+\exp(-u/\epsilon)] \quad (2)$$

The formula (2) becomes a unit step function when $\epsilon \rightarrow +0$, the output value of each neuron unit takes a binary value 1 or 0, and the formula (2) describes the excitation or inhibition state of the neuron. The output value of each neuron takes a value from 0 to 1 in other cases.

The most notable characteristic of the neural network, that is, the learning function and the self-organization, are based on the changes in the synapse coupling coefficient w (weighting of the coupling between the neurons) and the threshold value $\theta$ (but mainly the synapse coupling coefficient w). The synapse coupling coefficient w can be obtained from the following formulas (3), where k is a parameter satisfying $0<k<1$, c is a parameter satisfying $c>0$, $\delta i$ is a learning signal returned from the ith neuron of the output layer, di is a teaching signal which is a desirably output value of the ith neuron of the output layer, and f' is a differentiation of the output function f.

$$wi(t+1) = kwi(t) + c\delta i(t)yi(t) \quad (3)$$

$$\delta i = (di - Xi)f'\left[\sum_{i=1}^{N} wiyi(t) - \theta\right]$$

The learning function of the neural network can be summarized as follows. That is, in addition to transferring information from the input to the output among the layers, the error back-propagation is used to teach a desired output (teaching signal) from the output side to the input side a plurality of times so that the desired output is more likely to be output with respect to a certain input. The path of the input signal to the desired output is restricted by the coefficient w (weighting) among the paths, and arbitrarily given information is lead to the desired output by storing the coefficient w and varying the weighting between the neurons.

Next, a description will be given of the processes carried out by the main controller 40 shown in FIGS. 2 and 3, by referring to FIGS. 6, 7A and 7B.

Figure 6:
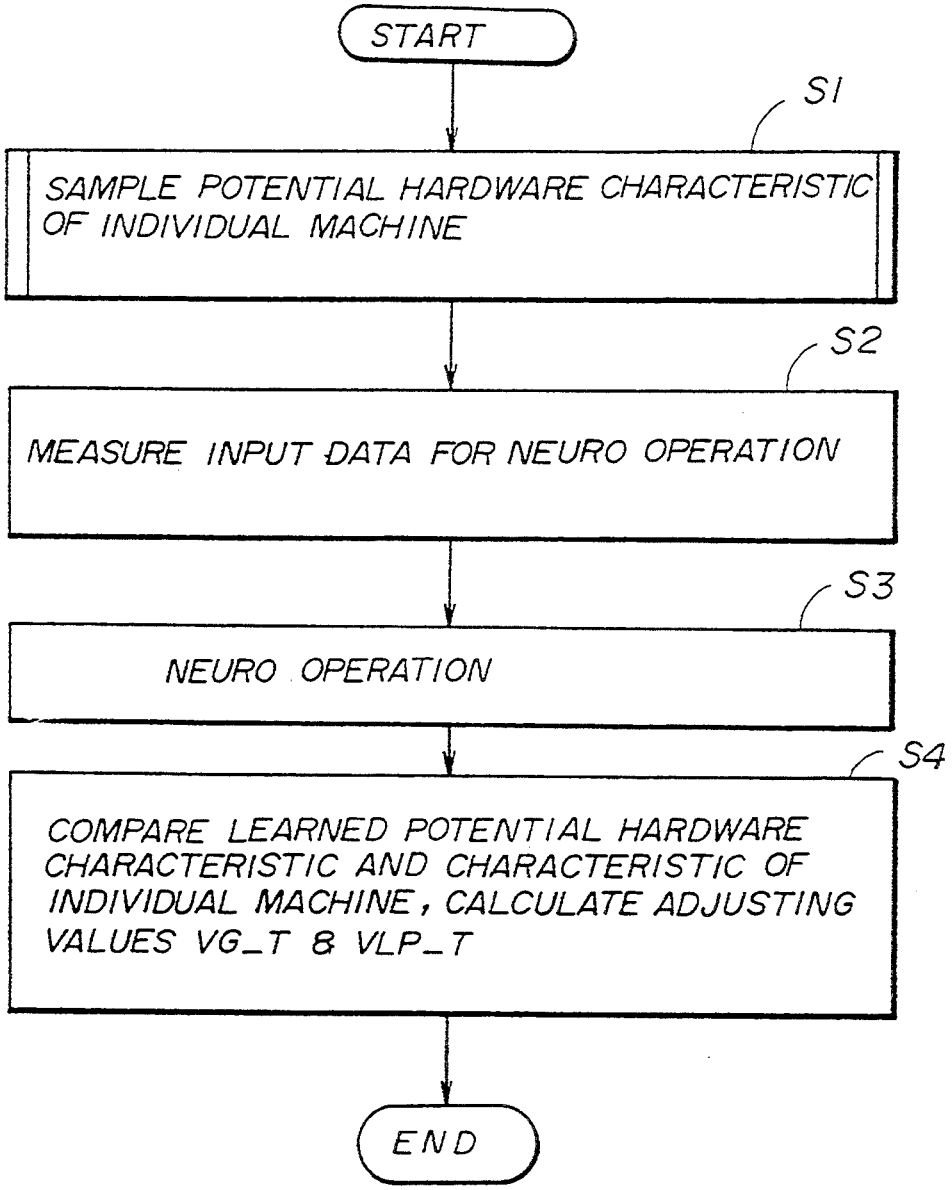
FIG. 6 is a flow chart for explaining an image potential adjusting process of the main controller shown in FIGS. 2 and 3.

FIG. 6 is a flow chart showing an image potential adjusting process of the main controller 40. The potential hardware characteristic of a reference copying machine at the time when the neural network learns is sampled and stored in advance. The potential hardware characteristic of the dark portion potential is mainly dependent on the photosensitive drum 2, the charger 4 and the grid voltage of the charger 4. On the other hand, the potential hardware characteristic of the bright portion potential is mainly dependent on the photosensitive drum 2, the charger 4, the grid voltage of the charger 4, and the amount of light emitted from the exposing lamp 10. When the power supply turns ON, a step S1 samples the potential hardware characteristic of the individual copying machine 1.

A step S2 measures input data which are used for the neuro operation. In other words, in order to estimate the dark portion potential and the bright portion potential described above, the grid voltage applied to the grid 4*b* of the charger 4, the lamp voltage applied to the exposing lamp 10, the surrounding temperature of the photosensitive drum 2, and the total number of prints (copies) made are sampled as the input data. In this case, the grid voltage and the lamp voltage are software control target values.

A step S3 carries out the neuro operation based on the input data, so as to calculate a grid target voltage VG and an exposing lamp target voltage VLP which are input if the dark portion potential and the bright portion potential are estimated to be certain target potentials which are respectively 720 V and 170 V, for example.

A step S4 compares the potential hardware characteristic at the time of the learning and the potential hardware characteristic of the individual copying machine 1, and calculates a difference. In addition, the step S4 calculates the control target values VG_T and VLP_T which are obtained by respectively adjusting the calculated grid target voltage VG and exposing lamp target voltage VLP based on the calculated difference. The actual calculation will be described later.

Figure 7A:
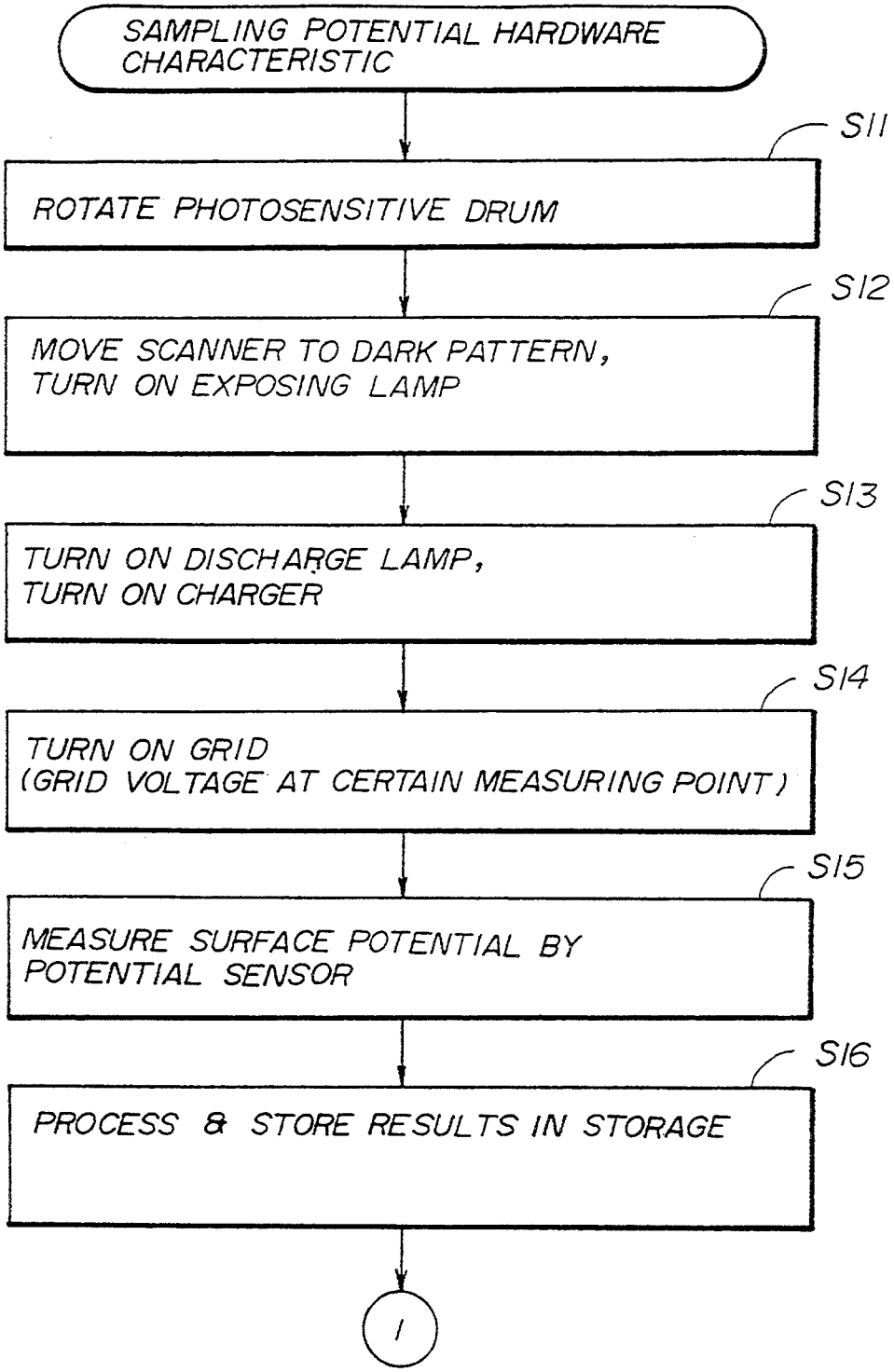
FIGS. 7A and 7B respectively are flow charts for explaining processes of sampling the potential hardware characteristic of the individual copying machine.
Figure 7B:
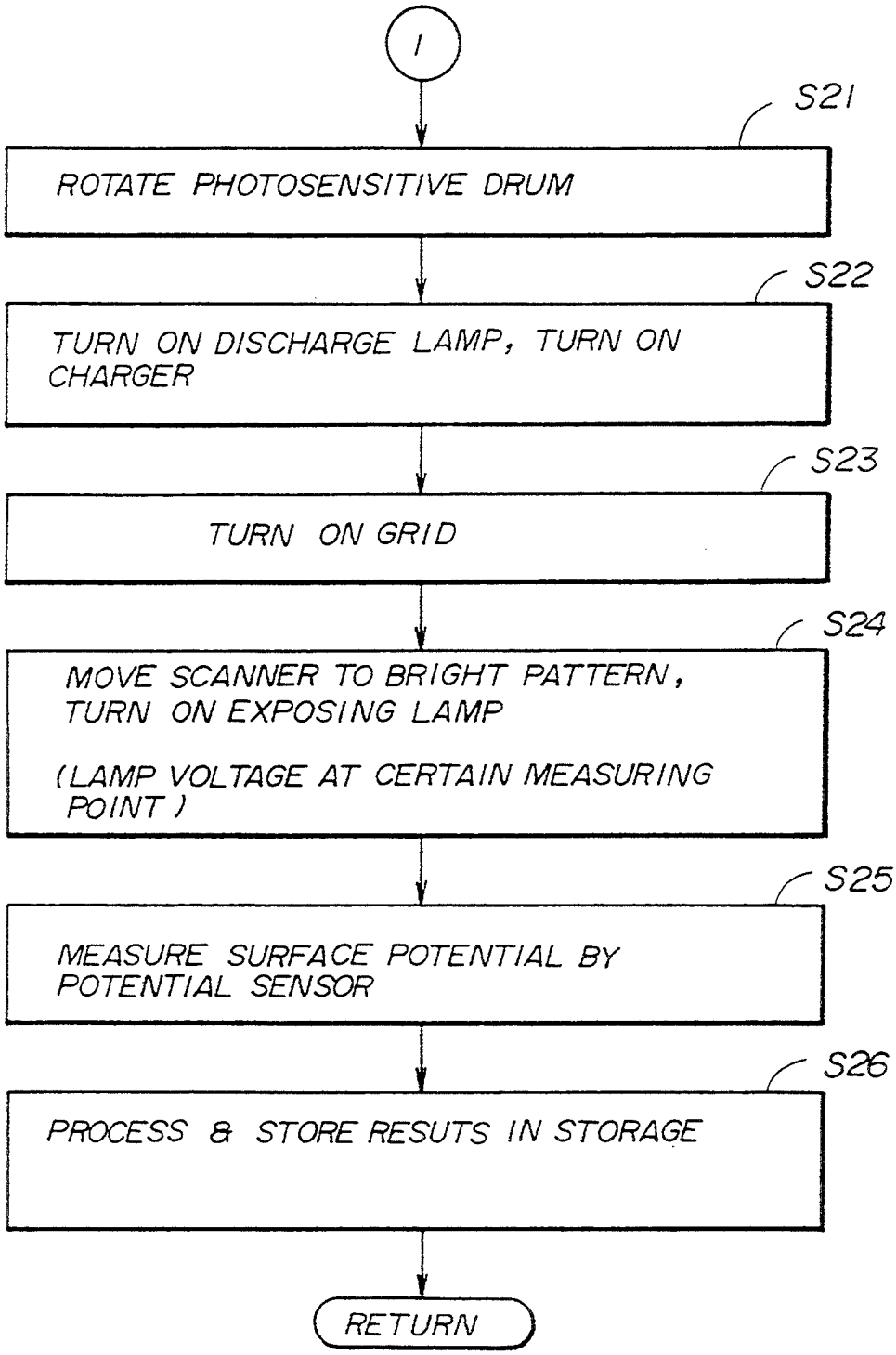

The process of sampling the potential hardware characteristic of the individual copying machine 1 is carried out by executing a sampling process for the dark portion potential VD shown in FIG. 7A and a sampling process for the bright portion potential VL shown in FIG. 7B.

In FIG. 7A, a step S11 rotates the photosensitive drum 2, and a step S12 moves the scanner to a position confronting the dark pattern and turns ON the exposing lamp 10. In this state, the lamp voltage applied to the exposing lamp 10 has a fixed value of 65 V, for example.

Then, a step S13 turns ON the discharge lamp 5 and turns ON the charger 4 by applying a charge voltage to the discharge wire 4*a* of the charger 4 (charge ON) from the high voltage generation circuit 53. In addition, a step S14 applies a grid voltage to the grid 4*b* of the charger 4 (grid ON) from the high voltage generation circuit 54. If the grid voltage used is in the range of 700 to 1000 V, the measuring point is successively changed each time as 700 V, 800 V, 900 V and 1000 V.

Thereafter, a step S15 measures the surface potential of the photosensitive drum 2 using the potential sensor 38, and this measurement of the surface potential is repeated for each of the measuring points described above. Finally, a step S16 processes the results of the measurements and stores the results in the data storage 43 shown in FIG. 2. The results of the measurements may be processed according to one of the following two methods, for example.

According to a first processing method, the grid. voltage VG is taken along the X-axis and the dark portion potential VD is taken along the Y-axis. Each of the measured points are connected by lines to obtain three first order equations. These three first order equations are stored in the data storage 43.

On the other hand, according to a second processing method, an average of the grid voltage VG at the measuring points of 700 V and 800 V, an average of the grid voltage VG at the measuring points of 800 V and 900 V, and an average of the grid voltage VG at the measuring points of 900 V and 1000 V are obtained. These three averages are stored in the data storage 43 as the measured results (dark portion potential VD) at the typical points.

Next to the process shown in FIG. 7A, the process shown in FIG. 7B is carried out to sample the bright portion potential VL. In FIG. 7B, a step S21 rotates the photosensitive drum 2, and a step S22 turns ON the discharge lamp 5 and thereafter applies a charge voltage to the discharge wire 4*a* of the charger 4 (charge ON) from the high voltage generation circuit 53. In addition, a step S23 applies a grid voltage to the grid 4*b* of the high voltage generation circuit 54 (grid ON) from the high voltage generation circuit 54. In this state, the grid voltage has a fixed value of 900 V, for example.

Then, a step S24 moves the scanner to a position confronting the bright pattern and turns ON the exposing lamp 10. In this state, the lamp voltage applied to the exposing lamp 10 has a fixed value of 65 V, for example. If the lamp voltage used is in the range of 60 to 75 V, the measuring point is successively changed each time as 60 V, 65 V, 70 V and 75 V.

Thereafter, a step S25 measures the surface potential of the photosensitive drum 2 using the potential sensor 38, and this measurement of the surface potential is repeated for each of the measuring points described above. Finally, a step S26 processes the results of the measurements and stores the results in the data storage 43 shown in FIG. 2. The results of the measurements may be processed according to one of the following two methods, for example.

According to a first processing method, the lamp voltage VLP is taken along the X-axis and the bright portion potential VL is taken along the Y-axis. Each of the measured points are connected by lines to obtain three first order equations. These three first order equations are stored in the data storage 43.

On the other hand, according to a second processing method, an average of the lamp voltage VLP at the measuring points of 60 V and 65 V, an average of the lamp voltage VLP at the measuring points of 65 V and 70 V, and an average of the lamp voltage VLP at the measuring points of 70 V and 75 V are obtained. These three averages are stored in the data storage 43 as the measured results (bright portion potential VL) at the typical points.

When sampling the potential hardware characteristic of the copying machine 1 at the time of the learning prestored in the data storage 43, processes similar to those shown in FIGS. 7A and 7B are carried out by use of a copying machine which is specified as the reference copying machine in order to sample the potential hardware characteristic thereof.

Next, a description will be given of examples of the numerical calculation of the adjusting value at the last step S4 shown in FIG. 6.

First, a description will be given of the numerical calculation of the adjusting value for the case where the three first order equations are stored in the data storage 43 by the process of sampling the potential hardware characteristic. In this case, it is assumed that VD(measured value)=a x VG(grid voltage)+b and the following formulas (4) stand from the measured data at the time of the learning, where VD_700_G denotes the measured value of the dark portion potential VD at the grid voltage VG of 700 V at the time of the learning, VD_800_G denotes the measured value of the dark portion potential VD at the grid voltage VG of 800 V at the time of the learning, a7_8_G denotes an inclination of the first order equation between the grid voltages of 700 V and 800 V at the time of the learning, and $b7_{_8_}G$ denotes an intercept of the first order equation between the grid voltages of 700 V and 800 V at the time of the learning.

$$VD_700_G = a7_8_G \times 700 + b7_8_G$$

$$VD_800_G = a7_8_G \times 800 + b7_8_G \quad (4)$$

The inclination "a7_8_G" and the intercept "b7_8_G" are ,obtained from the formulas (4).

Similarly, an inclination "a7_8_S" and an intercept "b7_8_S" are obtained from the measured results of the individual copying machine 1.

If the grid control target value VG_N calculated by the neuro operation is 700 to 800 V, the dark portion potential VD_N is calculated by the following formula (5) based on the inclination and the intercept which are obtained from the measured results at the time of the learning.

$$VD_N = a7_8_G \times VG_N + b7_8_G \quad (5)$$

Furthermore, the target value VG_T of the grid voltage VG is calculated by the following formula (6) based on the inclination and the intercept which are obtained from the measured results of the individual copying machine 1.

$$VG_T = (VD_N - b7_8_S)/a7_8_S \quad (6)$$

In other words, the inclination "a7_8_S" and the intercept "b7_8_S" are used if VD_700_S≦VD_N≦VD_800_S.

The target value VLP_T of the lamp voltage VLP is obtained similarly to the above.

In this case, the inclination and the intercept of the individual copying machine 1 can be obtained by using VL in place of VD and using VLP in place of VG.

Next, a description will be given of the numerical calculation of the adjusting value for the case where the three typical points are stored in the data storage 43 by the process of sampling the potential hardware characteristic.

In this example, the conditions are set similarly to the above described example, and the typical points are obtained from the following formulas (7) by setting one range from 700 to 800 V, where VD_7_8_DG denotes a typical point at the time of the learning for the grid voltage VG of 700 to 800 V, and VD7_8_DS denotes a typical point of the individual copying machine 1 for the grid voltage VG of 700 to 800 V.

$$VD7_8_DG=(VD_800_G-VD_700_G)/2$$

$$VD7_8_DS=(VD_800_S-VD_700_S)/2 \quad (7)$$

A difference VD7_8_D between the potential at the time of the learning and the potential of the individual copying machine 1 is obtained from the following formula, where VD7_8_D denotes a difference between the typical point at the time of the learning and the typical point of the individual copying machine 1 for the grid voltage VG of 700 to 800 V.

$$VD7_8_D=VD7_8_DG-VD7_8_DS$$

Furthermore, this potential (difference) is converted into the target value VG_T of the grid voltage VG based on the following formulas (8).

$$\Delta VG=1.06\times VD7_8_D$$

$$VG_T=VD_N+\Delta VG \quad (8)$$

The target value VLP_T of the lamp voltage VLP is obtained similarly to the above. But in this case, the following formulas (9) are used in place of the formulas (8).

$$\Delta VG=0.4\times VD7_8_D$$

$$VG_T=VD_N+\Delta VG \quad (9)$$

In the embodiment described above, the present invention is applied to the copying machine which uses the photosensitive drum. However, the present invention is of course similarly applicable to a copying machine which uses a photosensitive belt, an optical printer such as a laser printer, a facsimile machine and the like. In other words, the present invention may be applied to all kinds of image forming apparatuses which employ the electrophotography technique.

Of course, the neural network used in the present invention is not limited to that shown in FIG. 4, and various types of neurons and neural networks may be used. In addition, the neural network itself may be realized by hardware or by software. For example, the neuron units and the neural networks are further disclosed in U.S. Pat. Nos. 5,131,073, 5,191,637, 5,185,851 and 5,167,006, the disclosures of which are hereby incorporated by reference.

Further, the present invention is not limited to these embodiments, but various variations and modifications may be made without departing from the scope of the present invention.

What is claimed is:

1. An image potential control system adapted to control an image potential of a photosensitive body of an image forming apparatus which includes controlled systems including the photosensitive body and which carries out an electrophotography process, said image potential control system comprising:

a) storage means for storing at least (A) controlled variables of the controlled systems and (B) a control program; and b) processing means, coupled to said storage means and including adjusting means, for controlling the controlled variables based on the control program and for using a neural operation to adjust a dark portion potential and a bright portion potential of the photosensitive body; wherein said adjusting means includes:

b1) means for comparing:

(A) a learned characteristic of a reference image forming apparatus and (B) a characteristic of the image forming apparatus, to arrive at adjusting values; and b2) means for correcting input data or output data of the neural operation based on the adjusting values.

2. The image potential control system as claimed in claim 1, wherein said adjusting means obtains the differences by comparing a learned potential hardware characteristic of the dark portion potential related to the reference image forming apparatus and a potential hardware characteristic of the dark portion potential related to the image forming apparatus, each of said potential hardware characteristics being dependent on the photosensitive body, a charger and a grid voltage of the charger of the respective image forming apparatuses.

3. The image potential control system as claimed in claim 1, wherein said adjusting means obtains the differences by comparing a learned potential hardware characteristic of the bright portion potential related to the reference image forming apparatus and a potential hardware characteristic of the bright portion potential related to the image forming apparatus, each of said potential hardware characteristics being dependent on the photosensitive body, a charger, a grid voltage of the charger and an amount of light emitted from an exposing light source of the respective image forming apparatuses.

4. The image potential control system as claimed in claim 1, which further comprises:

first detection means, coupled to said processing means, for detecting controlled variables of the controlled systems of the image forming apparatus;

second detection means, coupled to said processing means, for detecting a property related to the controlled variables detected by said first detection means; and input means, coupled to said processing means, for inputting manipulated variables for controlling the controlled variables detected by said first detection means, said storage means storing the controlled variables, the property, the manipulated variables and computation data.

5. An image forming apparatus which carries out an electrophotography process, said image forming apparatus comprising:

a) a plurality of controlled systems including a photosensitive body;

b) storage means for storing at least (A) controlled variables of said controlled systems and (B) a control program; and c) processing means, coupled to said storage means and including adjusting means, for controlling the controlled variables based on the control program and for using a neural operation to adjust a dark portion potential and a bright portion potential of the photosensitive body, wherein said adjusting means includes:

c1) comparing means for comparing:

(A) a learned characteristic of a reference image forming apparatus and (B) a characteristic of the image forming apparatus, to arrive at adjusting values; and c2) means for correcting input data or output data of the neural operation based on the adjusting values.

6. The image forming apparatus as claimed in claim 5, wherein said adjusting means obtains the differences by comparing a learned potential hardware characteristic of the dark portion potential related to the reference image forming apparatus and a potential hardware characteristic of the dark portion potential related to the image forming apparatus, each of said potential hardware characteristics being dependent on the photosensitive body, a charger and a grid voltage of the charger of the respective image forming apparatuses.

7. The image forming apparatus as claimed in claim 6, wherein said adjusting means includes measuring means for measuring the potential hardware characteristic.

8. The image forming apparatus as claimed in claim 7, wherein said adjusting means includes means for restricting the measured potential hardware characteristic to a range of the output data used and connects a plurality of measuring points by first order equations, and said comparing means compares the first order equations with the learned potential hardware characteristic.

9. The image forming apparatus as claimed in claim 7, wherein said adjusting means includes means for restricting the measured potential hardware characteristic to a range of the output data used and divides the range to obtain data related to typical points within each of divided ranges, and said comparing means compares the data related to the typical points.

10. The image forming apparatus as claimed in claim 5, wherein said adjusting means obtains the differences by comparing a learned potential hardware characteristic of the bright portion potential related to the reference image forming apparatus and a potential hardware characteristic of the bright portion potential related to the image forming apparatus, each of said potential hardware characteristics being dependent on the photosensitive body, a charger, a grid voltage of the charger and an amount of light emitted from an exposing light source of the respective image forming apparatuses.

11. The image forming apparatus as claimed in claim 10, wherein said adjusting means includes measuring means for measuring the potential hardware characteristic.

12. The image forming apparatus as claimed in claim 11, wherein said adjusting means includes means for restricting the measured potential hardware characteristic to a range of the output data used and connects a plurality of measuring points by first order equations, and said comparing means compares the first order equations with the learned potential hardware characteristic.

13. The image forming apparatus as claimed in claim 11, wherein said adjusting means includes means for restricting the measured potential hardware characteristic to a range of the output data used and divides the range to obtain data related to typical points within each of divided ranges, and said comparing means compares the data related to the typical points.

14. The image forming apparatus as claimed in claim 5, which further comprises:

first detection means, coupled to said processing means, for detecting controlled variables of said controlled systems;

second detection means, coupled to said processing means, for detecting a property related to the controlled variables detected by said first detection means; and input means, coupled to said processing means, for inputting manipulated variables for controlling the controlled variables detected by said first detection means, said storage means storing the controlled variables, the property, the manipulated variables and computation data.

* * * * *